US005952637A

United States Patent [19]

Strunk

[11] Patent Number: 5,952,637

[45] Date of Patent: Sep. 14, 1999

[54] PORTABLE FOLDING BOARD GAMES

[76] Inventor: Jeffrey L. Strunk, 293 Porter Nadeau Rd., P.O. Box 64, Eustis, Me. 04936

[21] Appl. No.: 08/974,437

[22] Filed: Nov. 20, 1997

[51] Int. Cl.[6] ..... G06K 1/08; E05D 1/00

[52] U.S. Cl. ..... 235/90; 273/148 A; 16/225

[58] Field of Search ..... 235/90; 273/148 A, 273/185, 282.1; 16/225

[56] References Cited

U.S. PATENT DOCUMENTS

| | | | |
|---|---|---|---|
| 2,013,958 | 9/1935 | Hughes | 235/90 |
| 2,288,671 | 4/1942 | Batchelder | 235/90 |
| 2,384,040 | 2/1945 | Miller | 235/90 |
| 2,582,874 | 6/1952 | Loeb | 235/90 |
| 4,854,586 | 8/1989 | Morce | 273/249 |
| 4,984,808 | 1/1991 | Young | 273/283 |
| 5,213,326 | 5/1993 | Rundell et al. | 273/148 A |
| 5,407,206 | 4/1995 | Cohen | 273/249 |
| 5,490,675 | 2/1996 | Persidsky et al. | 273/287 |

*Primary Examiner*—Michael G. Lee
*Assistant Examiner*—Daniel St. Cyr
*Attorney, Agent, or Firm*—Pierce Atwood; Chris A. Caseiro; Celia H. Leber

[57] ABSTRACT

Portable folding board games are provided. These games include a pair of elongate board members. A first side of each board member includes (i) a plurality of apertures each constructed to receive a game peg, and (ii) a well constructed to retain a plurality of game pegs when the board is not in use, and an opposite side of each board member includes (i) a first slot, extending across the width of the board member near a first end of the board member, and (ii) a second slot, extending across the width of the board member near the opposite end of the board member. The board game further includes a pair of securing loops, each loop being constructed to be wrapped around the two board members, when the board members are placed with their first sides facing, in a manner so that the loop extends into the first and second slots and is retained therein. Cribbage board systems are also provided.

22 Claims, 3 Drawing Sheets

PORTABLE FOLDING BOARD GAMES

BACKGROUND OF THE INVENTION

The present invention relates to portable folding board games, e.g., cribbage or chess games.

Many board games have been made portable, often by making the board of several pieces which are hinged so that the board can be folded.

Cribbage, a card game in which the score is kept by inserting small pegs into holes arranged in rows on a small game board, has long enjoyed great popularity. Cribbage enthusiasts often wish to take a cribbage board and cards along with them while travelling. Portable cribbage boards—typically either small sized boards or folding boards with metal hinges—are widely available to meet this need.

SUMMARY OF THE INVENTION

The present invention provides portable folding board games that are suitable for use under a wide variety of circumstances. For example, preferred boards are made entirely of materials that will not be damaged by exposure to water, and thus these boards can be used during outdoor activities such as boating and backpacking. The invention also features cribbage board systems that include a folding cribbage board, a pack of playing cards interposed between the two portions of the cribbage board when it is folded, and a plurality of cribbage pegs retained in a well in the interior of the folded cribbage board.

In one aspect, the invention features a portable folding board game including a pair of elongate board members. A first side of each board member includes (i) a plurality of apertures each constructed to receive a game peg, and (ii) a well constructed to retain a plurality of game pegs when the board is not in use, and an opposite side of each board member includes (i) a first retaining portion, extending across the width of the board member near a first end of the board member, and (ii) a second retaining portion, extending across the width of the board member near the opposite end of the board member. The board game further includes a pair of securing loops, each loop being constructed to be wrapped around the two board members, when the board members are placed with their first sides facing, in a manner so that the loop is retained by the first and second retaining portions.

In preferred embodiments, the securing loops are formed of an elastic cord. Preferably, the cord has sufficient elasticity to act as a hinge when the board members are moved apart to open the folding board and to allow the cord to be easily removed from the board and placed around the board. The retaining portions are preferably slots or bores. Preferably, the board game is cribbage and the game pegs are cribbage pegs.

In another aspect, the invention features a cribbage board system including a cribbage board as described above, a pack of playing cards, and a plurality of cribbage pegs. The cribbage board has a predetermined width that is narrower than the width of the playing cards and the securing loops have an elasticity selected to retain the playing cards between the board members. The pegs are sized to fit within the well in the board so as to allow the board to be folded with the pegs in the well. Preferably, the width of the board is about 0.1" to 0.3" less than that of the playing cards.

Other features and advantages of the invention will be apparent from the following detailed description, the drawings, and the claims.

DETAILED DESCRIPTION OF PREFERRED EMBODIMENTS

Figure 1:
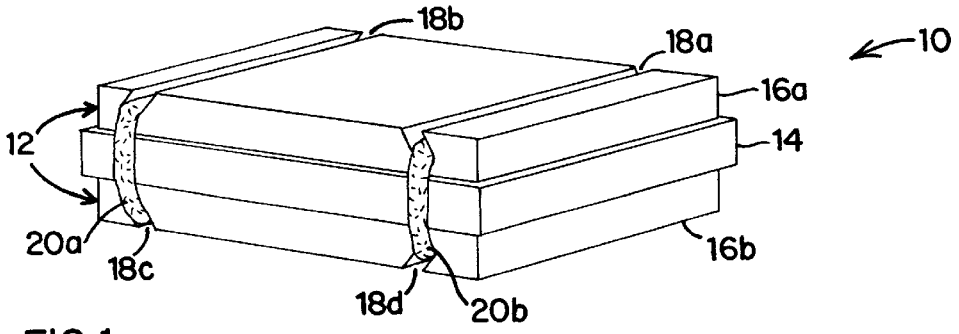
FIG. 1 is a perspective view.
Figure 1A:
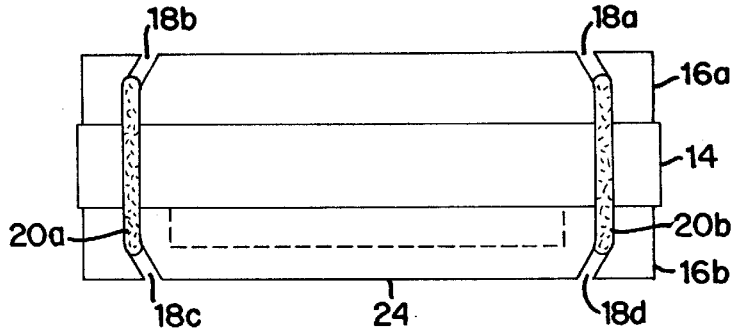
FIGS. 1*a* and 1*b* are side and end views, respectively, of a folding portable cribbage board according to one embodiment of the invention. The board is shown in its closed position.
Figure 1B:
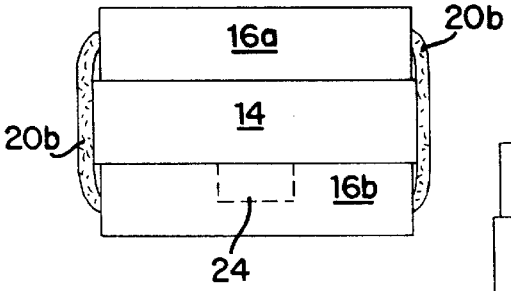
Figure 2:
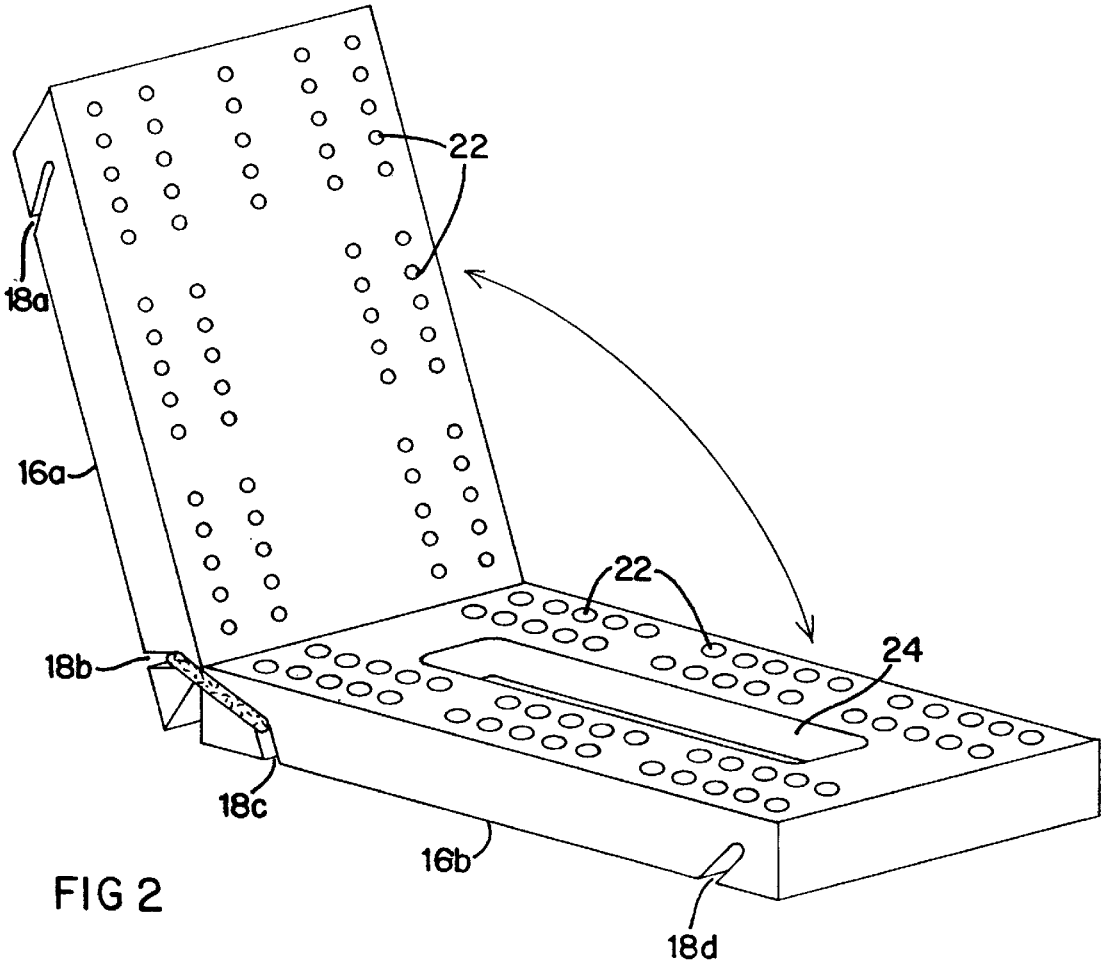
FIG. 2 is a perspective view of the folding portable cribbage board of FIG. 1 in a partially open position.

Referring to FIGS. 1–1*b*, a cribbage board system 10 includes a cribbage board 12 and a pack of cards 14. The pack of cards 14 is sandwiched between the two board members 16*a*, 16*b* which make up cribbage board 12. Each board member includes a pair of slots (18*a*, 18*b* on member 16*a*, 18*c*, 18*d* on member 16*b*), constructed to retain securing loops 20*a*, 20*b*. To more securely retain the securing loops, it is preferred that the slots be positioned at an angle of from about 45 to 85 or about 95 to 135 degrees with respect to the surface of the second side of the board member. It is further preferred that the slots angle away from each other as they extend into the board member, as shown in FIGS. 1, 1*a* and 2. Each of the slots 18*a*–18*d* is positioned substantially the same distance from its respective end of the corresponding board member, to allow the board members to be correctly aligned when the board is in the closed position shown in FIGS. 1–1*b*.

As shown in FIG. 1*b*, the width of the board members 16*a*, 16*b* is preferably slightly less than the width of the pack of cards 14, so that the securing loops 20*a*, 20*b* can securely engage the pack of cards by frictional engagement.

Figure 3:
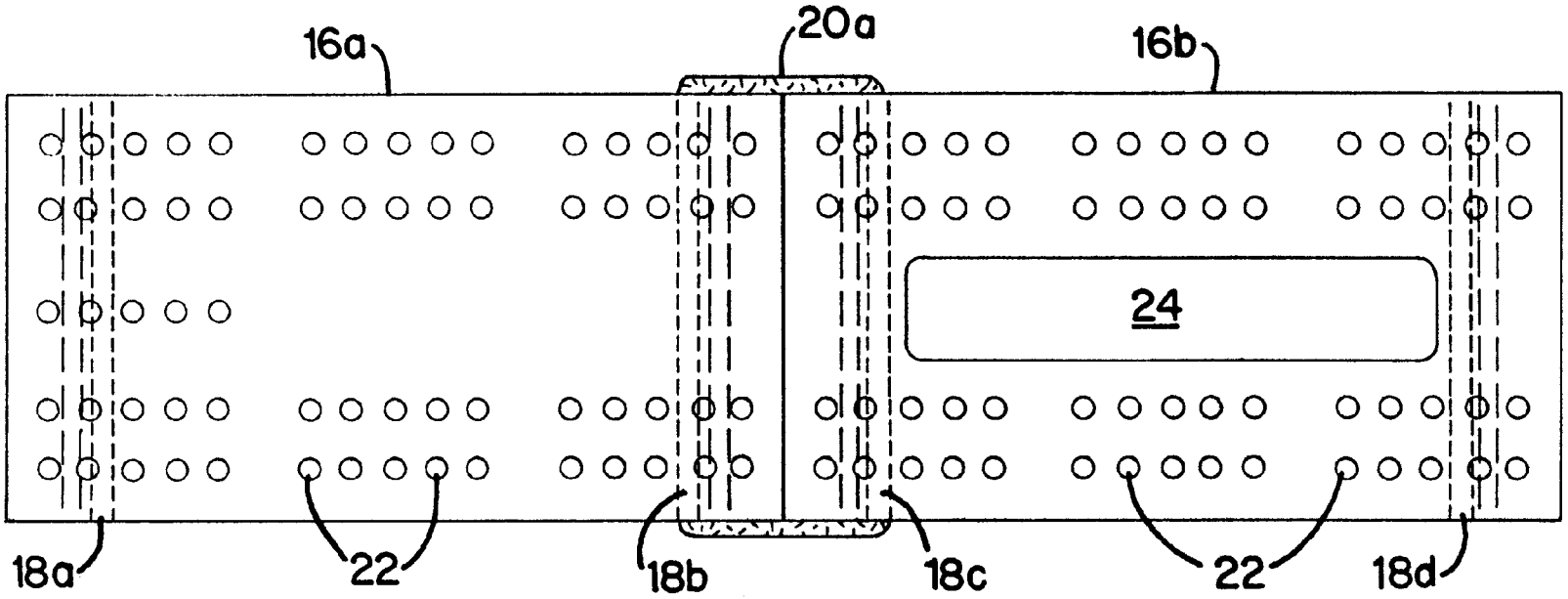
FIG. 3 is a top view of the folding portable cribbage board of FIG. 1 in its open position.

As shown in FIGS. 2 and 3, by removing one of the securing loops (here, loop 20*b*), the board members 16*a*, 16*b* may be rotated about the remaining securing loop (20*a*), with this securing loop acting as a hinge. When the cribbage board 12 is in its fully open position (FIG. 3), securing loop 20*a* functions to hold the two board members together to form a unitary cribbage board. The cribbage board 12 includes apertures 22, dimensioned to receive a cribbage peg and arranged in arrays as is conventional for cribbage boards. The cribbage board 12 also includes a well 24 that is dimensioned to receive a plurality of cribbage pegs, while still allowing the board members to be moved to and secured in the closed position shown in FIGS. 1–1*b*.

A wide variety of materials may be used to form the cribbage board and cribbage pegs. However, it is preferred that the board members be formed of wood, to give the cribbage board an attractive appearance, durability and to allow it to withstand exposure to moisture. Moreover, if the board members are wood, the cribbage board system can be used as an emergency fire-starting kit by providing waterproof matches for use as cribbage pegs (the cards can be used as paper to start a fire, and the board members will provide kindling). The securing loops are preferably elastic cords, as noted above. A preferred cord is a bungee cord. Such cords can be obtained from many cord manufacturers. The cord may be tied or secured in any desired manner to form a continuous loop.

The dimensions of the cribbage board, and arrangement of the apertures, can be varied as desired. In general, it is preferred that the cribbage board be small, so that it can be easily carried when backpacking and travelling light, e.g., that the board members each be from about 2.5 to 4.5" long and 1.5 to 3.0 inches wide. Preferred dimensions if the cribbage board is to be used in a cribbage board system with a standard pack of cards are as follows: board members are each 3.5" long by 2.375" wide; slots are each 0.25" wide and are positioned 0.75" from the respective end of the board member.

Figure 4:
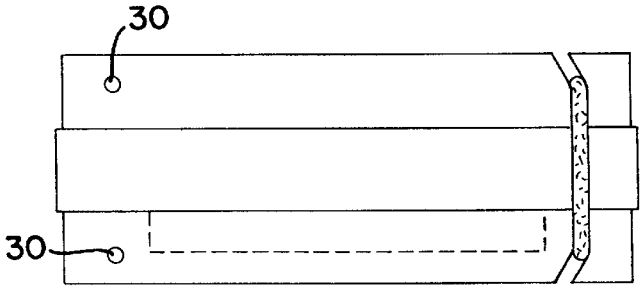
FIGS. 4 and 4*a* are side views of folding portable cribbage boards according to alternative aspects of the invention.
Figure 4A:
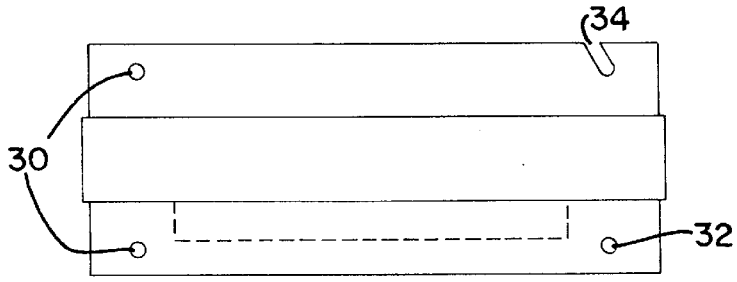

Alternatively, one or more of the slots can be replaced with a bore drilled through the board member, and the securing loop permanently retained in the bore. In the embodiment shown in FIG. 4, the two slots on the hinge side of the cribbage board are replaced by bores 30, and a cord (not shown) is threaded through both bores and secured to form a securing loop that connects the two bores. This modification will prevent the securing loop on the hinge side from coming off of the cribbage board when the board is in its open position, as may sometimes occur when slots are used. In the embodiment shown in FIG. 4*a,* in addition, one of the slots on the non-hinge side of the cribbage board is replaced by a bore 32. A cord (not shown) is threaded through bore 32 and secured, forming a securing loop that is permanently attached to one of the board members. The securing loop can then be easily put into or removed from slot 34, without the possibility that the securing loop will be misplaced while the board is in its open position. Other combinations of slots and bores may be used, provided that one retaining portion is a slot, allowing the securing loop to be removed from one side and the board opened.

Other embodiments are within the claims.

For example, while cribbage boards have been described and illustrated above by way of example, the folding board described can be used dice games. In this embodiment, the well would be dimensioned to hold dice in addition to pegs. For example, a pair of wells could be provided, one in each board member, aligned so that the two wells form a single dice well (e.g., dimensioned to accommodate standard 16 mm dice) when the two board members are in the closed position without a pack of cards between them. In one preferred embodiment, the dice well is dimensioned to accommodate at least five standard sized dice. The dice well can be provided in addition to, or instead of, the well provided for the pegs (the pegs can be placed in the same well with the dice, if desired). In this embodiment, the board members will generally be longer than the board members described above to allow for the space taken up by the dice well.

The folding board can also be used in chess games and any other games which can be played on a board with pegs as game pieces. For example, for chess or checkers, the apertures would be arranged to simulate the spaces of a chess/checker board, and the pegs would be constructed to resemble chess or checker pieces.

Moreover, while the retaining portions have been described, in connection with the preferred embodiment, as slots and bores, the securing loops could be retained in any suitable manner. Suitable retaining portions are constructed to allow the securing loop on one side of the board to act as a hinge, and the securing loop on the opposite side to be at least partially removable so that the board can be opened.

What is claimed is:

1. A portable folding board game comprising:

a pair of elongate board members, a first side of each board member including (i) a plurality of apertures each constructed to receive a game peg, and (ii) a well constructed to retain a plurality of game pegs when the board is not in use, and an opposite side of each board member including (i) a first retaining portion, extending across the width of the board member near a first end of the board member, and (ii) a second retaining portion, extending across the width of the board member near the opposite end of the board member; and a pair of securing loops, each loop being constructed to be wrapped around the two board members, when the board members are placed with their first sides facing, in a manner so that the loop is retained by the first and second retaining portions.

2. The portable folding board game of claim 1 wherein said securing loops are formed of an elastic cord.

3. The portable folding board game of claim 2 wherein the cord has sufficient elasticity to act as a hinge when the board members are moved apart to open the folding board.

4. The portable folding board game of claim 1 wherein at least one of said retaining members is a slot.

5. The portable folding board game of claim 4 wherein all of said retaining members are slots.

6. The portable folding board game of claim 5 wherein each pair of slots is constructed so that the slots angle away from each other as they extend into the board member.

7. The portable folding board game of claim 4 wherein at least one of said retaining members is a bore.

8. The portable folding board game of claim 4 wherein each of said slots is disposed at an angle of from 45 to 135 degrees with respect to the surface of the second side of the board member.

9. The portable folding board game of claim 1 wherein each of said slots is disposed at a predetermined distance from the adjacent end of the respective board member and the predetermined distances are substantially equal.

10. The portable folding board game of claim 1 wherein the board game is cribbage and the game pegs are cribbage pegs.

11. The portable folding board game of claim 1 wherein the board game is chess and the game pegs resemble chess pieces.

12. The portable folding board game of claim 1 wherein the board game is a dice game, and the board members include a well constructed to receive at least one die.

13. The portable folding board game of claim 12 wherein each board member includes a half-dice well and the half-dice wells are aligned to form a single dice well when the board members are in their closed position.

14. The portable folding board game of claim 13 wherein the dice well is dimensioned to accommodate up to five dice.

15. A cribbage board system comprising:

(a) a cribbage board including a pair of elongate board members, a first side of each board member including (i) a plurality of apertures each constructed to receive a cribbage peg, and (ii) a well constructed to retain a plurality of cribbage pegs when the board is not in use, and an opposite side of each board member including (i) a first retaining portion, extending across the width of the board member near a first end of the board member, and (ii) a second retaining portion, extending across the width of the board member near the opposite end of the board member; and a pair of securing loops, each loop being constructed to be wrapped around the two board members, when the board members are placed with their first sides facing, in a manner so that the loop is retained by the retaining portions;

(b) a pack of playing cards that, when the first sides of the board members are facing and the board is closed, are sandwiched between the board members, and (c) a plurality of cribbage pegs.

16. The cribbage board system of claim 15 wherein the cribbage board has a predetermined width that is narrower than the width of the playing cards and the securing loops have an elasticity selected to retain the playing cards between the board members.

17. The cribbage board system of claim 16 wherein the width of said cribbage board is about 0.1" to 0.3" less than the width of the playing cards.

18. The cribbage board system of claim 15 wherein said cribbage pegs are sized to fit within the well in the board so as to allow the board to be folded with the cribbage pegs in the well.

19. The cribbage board system of claim 15 wherein said board members are formed of wood and said cribbage pegs are matches, to provide an emergency fire-starting kit.

20. The cribbage board system of claim 15 wherein at least one of said retaining portions is a slot.

21. The cribbage board system of claim 20 wherein all of said retaining portions are slots.

22. The cribbage board system of claim 20 wherein at least one of said retaining portions is a bore.

* * * * *